US006526682B2

(12) United States Patent
Lee

(10) Patent No.: US 6,526,682 B2
(45) Date of Patent: Mar. 4, 2003

(54) FLAT LIGHT PANEL THIN MOUNT ILLUMINATED PICTURE FRAME

(76) Inventor: Jack R. Lee, 7216 Grubby Thicket Way, Bethesda, MD (US) 20817-1510

( * ) Notice: Subject to any disclaimer, the term of this patent is extended or adjusted under 35 U.S.C. 154(b) by 0 days.

(21) Appl. No.: 09/801,894

(22) Filed: Mar. 9, 2001

(65) Prior Publication Data

US 2001/0045039 A1 Nov. 29, 2001

Related U.S. Application Data

(60) Provisional application No. 60/188,167, filed on Mar. 10, 2000.

(51) Int. Cl.[7] ..... A47G 1/06
(52) U.S. Cl. ..... 40/716; 40/714
(58) Field of Search ..... 40/714, 716, 564, 40/544, 768, 124.02, 152.2

(56) References Cited

U.S. PATENT DOCUMENTS

| | | | | | |
|---|---|---|---|---|---|
| 3,255,544 | A | | 6/1966 | Bornholt | 40/156 |
| 3,318,032 | A | * | 5/1967 | Robison et al. | 40/714 |
| 3,862,505 | A | | 1/1975 | Jeroma | 40/132 |
| 4,096,656 | A | * | 6/1978 | Diceglie | 40/564 |
| 4,583,309 | A | | 4/1986 | Kane et al. | 40/152 |
| 4,942,685 | A | | 7/1990 | Lin | 40/152.2 |
| 4,947,565 | A | | 8/1990 | Shadwell | 40/152 |
| 5,130,898 | A | | 7/1992 | Akahane | 362/31 |
| 5,339,550 | A | * | 8/1994 | Hoffman | 40/204 |
| 5,657,563 | A | | 8/1997 | Lane | 40/219 |
| 5,664,352 | A | | 9/1997 | Beckman | 40/545 |
| 5,676,444 | A | | 10/1997 | Liao | 362/31 |
| 5,899,012 | A | | 5/1999 | Grum | 40/716 |
| 5,915,855 | A | | 6/1999 | Murase et al. | 40/546 |
| 5,950,342 | A | | 9/1999 | Sueholtz | 40/768 |
| 6,052,933 | A | * | 4/2000 | Lytle | 248/683 |

* cited by examiner

*Primary Examiner*—S. Joseph Morano
*Assistant Examiner*—Jason R. Bellinger
(74) *Attorney, Agent, or Firm*—Liniak, Berenato & White, LLC

(57) ABSTRACT

A fastening system and method to secure a light panel to the rear of a picture frame through the use of dual locking refittable fasteners in combination with retainers of the frame. The versatile thin illumination assembly system, consisting of the combination of the light panel and mounting system, can be applied to most existing display frames, thus converting a non-illuminated picture frame to an illuminated picture frame. The system when coupled with a frame creates an open backing that maintains the original light panel housing and eliminates heat buildup or dissipation complications often experienced with closed mounting systems. The mounting system and method requires no additional tools for the assembly process, and the resulting frame assembly is thin and easy to assemble.

16 Claims, 2 Drawing Sheets

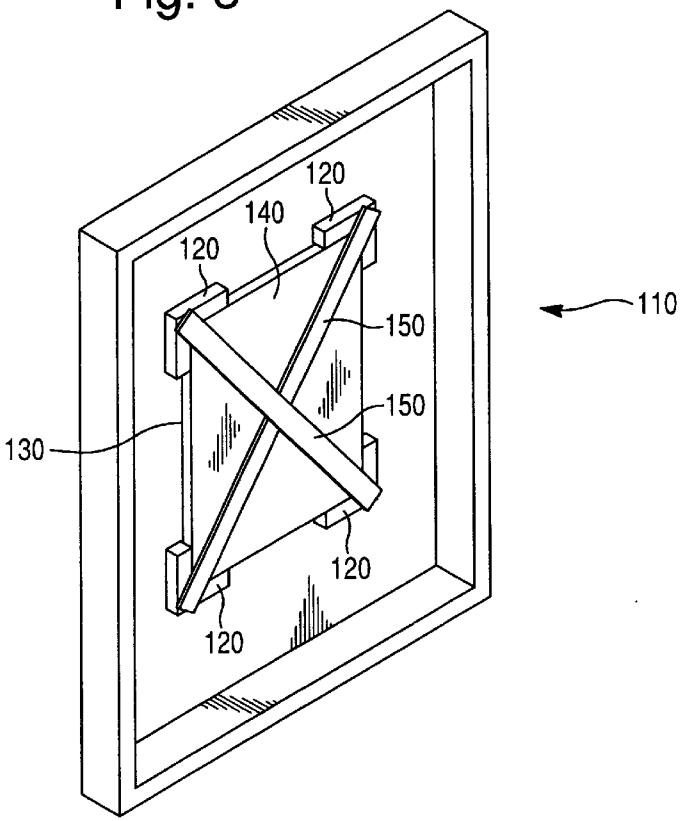
Fig. 3
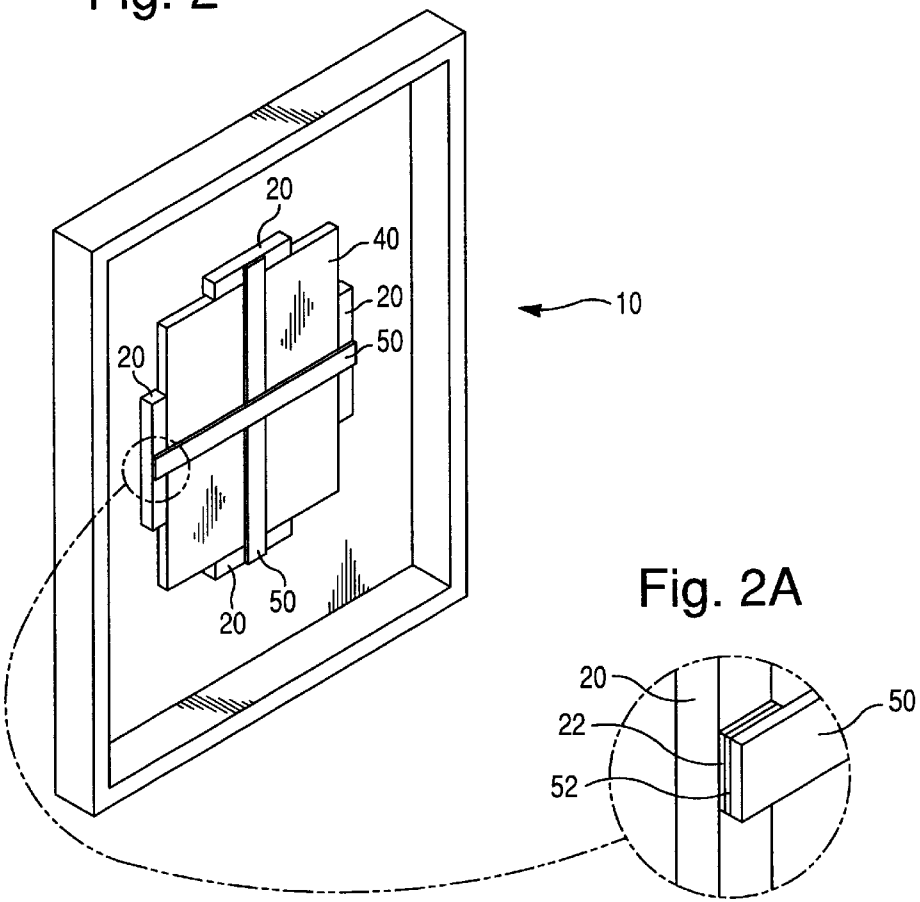
Fig. 2
Fig. 2A

FLAT LIGHT PANEL THIN MOUNT ILLUMINATED PICTURE FRAME

This application claims the benefit of U.S. Provisional Application No 60/188,167 filed Mar. 10, 2000.

BACKGROUND OF THE INVENTION

1. Field of the Invention

This invention relates to a framed display of artwork. More specifically, this invention relates to an display frame assembly incorporating an illuminated display for the artwork and a securing system for efficiently and effectively securing the display frame assembly together.

2. Description of Related Art

It is desirable to include some form of illumination when displaying artwork. Display of framed artworks ranges from illumination by natural reflected light, such as displays in a modern gallery, to conventional nearby incandescent or fluorescent lighting directed onto the surface of the artwork visible to a viewer, sometimes via a slightly recessed external lighting means. Many art displays are illuminated by some form of external lighting, whether an overhanging fixture or a supplemental form from, for example, a lamp. However, art displays illuminated by internal means are cumbersome and bulky. Similarly, when the display is over and the art needs to be changed, the process of replacing the existing art with a new subject is often a tedious process requiring time, tools, preparation, and often some form of skill.

Additionally, art frames for decorative art, mirrors, posters, pictures and the like may be formed from a plurality of sides, usually four, which are joined to each other at mitered ends. Many frame joints may open and come apart when subjected to stress. To overcome these problems, prior art frames have been manufactured with straps made from a variety of materials, including plastic, wire, or cardboard. The straps are designed to prevent the sides from pulling apart under ill proportioned stresses acting on the frame.

Prior art showing examples of security straps include the following: U.S. Pat. No. 5,950,342 to Suesholtz discloses a picture frame utilizing straps to prevent lateral movement of the frame's sides; U.S. Pat. No. 5,899,012 to Crum discloses an illuminated frame artwork display as well as retaining tabs in which to secure the light box in position over the artwork; U.S. Pat. No. 4,947,565 to Shadwell reveals use of pressure sensitive tape in order to allow pivoting of a backing sheet facilitating removal of the enclosed artwork; and U.S. Pat. No. 4,583,309 to Kane shows opposed strips of Velcro™ for holding a frame cover and a back sheet together.

The need exists for an improved display frame assembly having illumination means whereby a plurality of retainers position the light panel in combination with suitable fasteners to secure the light panel to the rear of the frame.

SUMMARY OF THE INVENTION

It is an object of the present invention to provide a method of securing a light panel to the rear of a picture frame through the use of dual locking refittable fasteners in combination with retainers of the frame.

An additional feature of the present inventions includes a back light illumination that enhances vibrant colors and provides a more dimensional effect on the artwork to be displayed. The versatile thin illumination assembly system, consisting of the combination of the light panel and mounting system, can be applied to most existing display frames, thus converting a non-illuminated picture frame to an illuminated picture frame. The system when coupled with a frame creates an open backing that maintains the original light panel housing and eliminates heat buildup or dissipation complications often experienced with closed mounting systems.

It is a further object of the invention to provide a mounting system whereby no additional tools are required to assemble the present invention with existing frames. The mounting method of this invention permits the quick and easy removal and installation of the light panel for changing displayed art or the enclosed transparency.

It is also an object of the present invention to provide an extremely thin and lightweight mounting system, wherein the impact of adding the additional components to an existing frame is negligent.

These advantages and other novel features of the present invention will become apparent in the following detailed description of the invention when considered in conjunction with the accompanying drawings.

BRIEF DESCRIPTIONS OF THE DRAWINGS

A better understanding of the present invention will be had when reference is made to the accompanying drawings, wherein identical parts are identified by identical reference numbers and wherein:

FIG. 2 is a schematic representation showing a perspective view of the present invention after assembly.

FIG. 2A is a fragmentary perspective view of a portion of the invention of FIG. 2 after assembly; and FIG. 3 is a perspective view of an alternate embodiment of the present invention.

DETAILED DESCRIPTION OF THE PRESENT INVENTION

Figure 1:
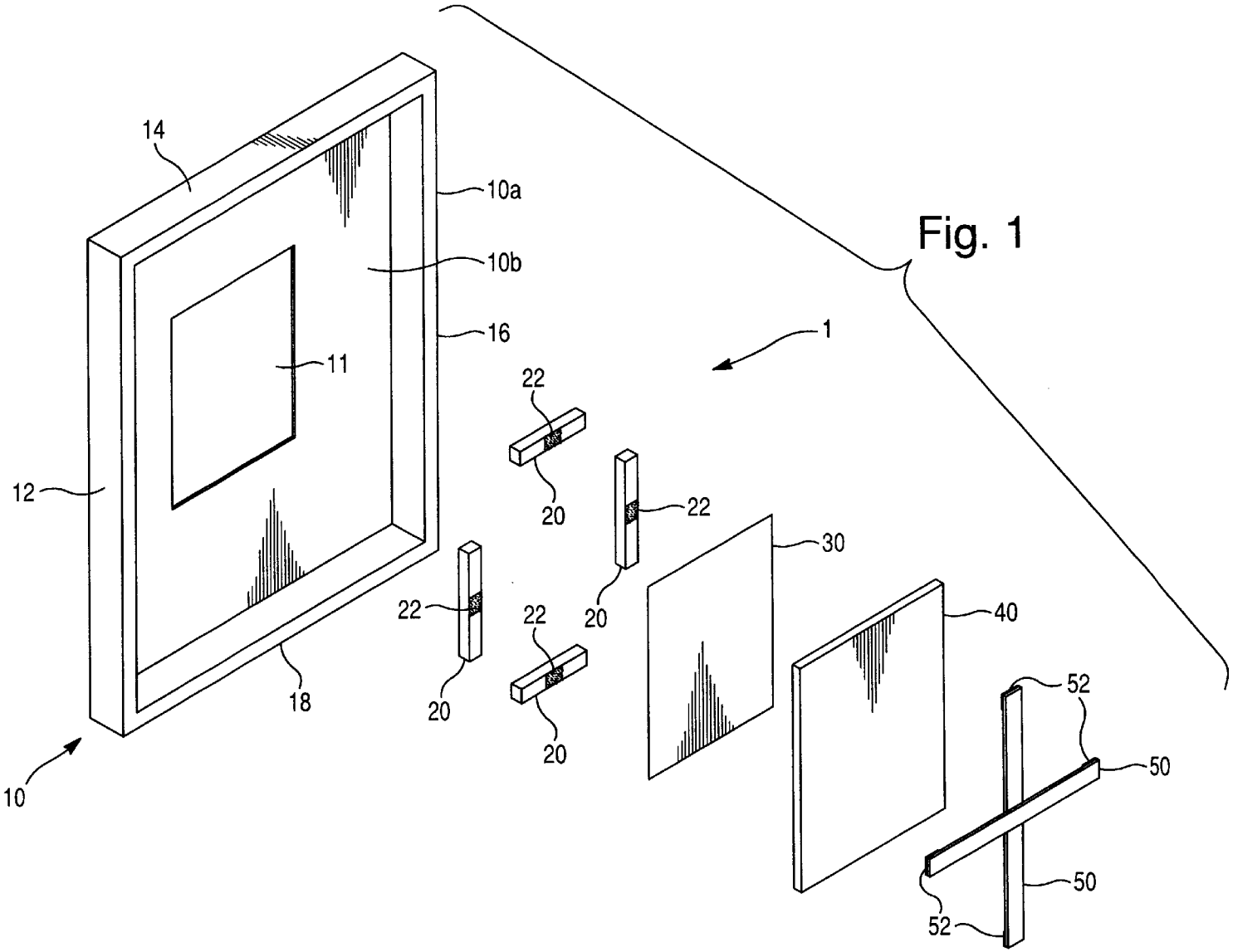
FIG. 1 is a schematic representation of an exploded perspective of the preferred embodiment of the present invention.

With reference to the accompanying drawings, the features of the invention will now be explained and will show that the present invention provides an innovative technique for securing a light panel to the rear of a picture frame.

A flat light panel, thin-mount, illuminated picture frame is constructed from two main components, a decorative display picture frame 10 and an electrically powered flat light panel 40 that provides the source of illumination to the artwork 30. The artwork 30 is not limited to any one particular form; in fact any picture, photograph, art transparent medium, or other physical object may be suitable for display area 11 of the picture frame 10.

The disclosed system and assembly method combine these two components to produce a thinly mounted and illuminated picture frame suitable for hanging, while permitting relatively rapid replacement of the artwork 30 being displayed. The disclosed system is not limited to wall mounting, but may also include mounting on a display stand, table or other similar object as is known in the art.

The display frame 10 is constructed in a manner similar to known frames within the art with an outer frame 10*a* and an inner frame 10*b* through which is formed the display area 11. For example, outer frame parts 12, 14, 16, and 18 are connected to one another to present a square shape. The ends of the frame parts 12, 14, 16 and 18 are mitered with ends having a surface with a forty-five degree angle (not specifically shown in the drawings). The mitered ends are abutted flatly with and adjoin to neighboring mitered end. The end product is a display frame 10 as depicted in FIG. 1. Other examples of display frames include designs formed from a mold using various materials such as steel, aluminum, plastic, clay, ceramic, or other suitable material.

The thin mount attachment is used to attach the light panel 40 to the frame 10. As seen in FIG. 1, the thin mount attachment is made of at least one retainer 20, preferable four in the case of a rectangular frame, a transparent medium 30, a flat light panel 40 and multiple-use cross-strapping locking fasteners 50.

FIG. 2 shows the invention in an assembled state and ready for display.

In order to achieve the assembled state, retainers 20 are positioned and adhesively secured onto the rear of the decorative frame 10 such that the inside perimeter formed by the retainers 20 corresponds with the outside perimeter of the light panel 40 to be inserted later. The retainers 20 may be secured by any suitable method as is known in the art, such as by adhesive, nails, screws, Velcro®, etc. The retainers 20 position the light panel 40 relative to the opening 11 of the frame 10 and also prevent the movement of the light panel 40 relative there once the framed display is assembled.

At least one cross-strapping locking fastener 50 is located vertically and/or horizontally across the light panel 40 and attached to the retainers 20. The cross-strapping locking system 50 maintains the flat light panel 40 against the decorative frame 10. Both the retainers 20 and the cross-strapping locking fastener 50 is preferably constructed to include duel locking reclosable fasteners 22, 52 that exhibit characteristics such as a strong tensile strength, resistance to ultraviolet light deterioration, light weight and thin. The preferred reclosable fastener is the Dual Lock™ reclosable fasteners manufactured by 3M™ which consist of a plurality (e.g., hundreds) of mushroom shaped stems that interlock with one another and produce an audible snapping sounding to announce that the fastener is locked while providing excellent tensile strength. Similarly, a hook and loop type reclosable fastener, such as Velcro™, or other reclosable fastener may be used with the present invention. The reclosable fasteners 22, 52 permit the straps 50 to be quickly disconnected from and reconnected to the retainers 20, so that the artwork 30 displayed within the frame 10 may be changed expeditiously with no additional tools or assistance.

The cross-strapping locking system, which is exemplified by fastener 50, is not limited to a vertical and horizontal disposition, but rather other embodiments may be used to facilitate the desired results, such as a diagonal disposition for irregular shaped frames or a grip-like pattern for increased strength. Likewise, a single strap extending across the back side of the light panel 40. In addition, it is preferable that the fastener 50 comprises flexible straps to permit versatile arrangement and disposition of the straps with respect to the frame 10.

The assembly method set forth by the present invention will now be described with reference to FIGS. 1 and 2. The art to be displayed is placed onto the flat light panel 40, preferably with a transparent retaining film sheet of rigid or semi-rigid material, such as Plexiglas or glass, protecting the exposed surface of the art. The flat light panel emits incandescent light such that when supplied with an electrical current, it radiates or glows. The flat light panel 40, with the artwork 30, is then placed between the retainers 20 so that the desired configuration of the art 30 is achieved. The straps of the cross-strapping locking system 50 are then secured to the frame. As seen in FIG. 2, the display is now assembled and ready to be hung on a wall or exhibited in some other manner.

The flat light panel is then connected to a power source to illuminate the entire display. Such a power source may be from any electrical current, e.g., hard wired within the building, a battery source. Should it be desired to change the art 30 contained within the frame 1, the cross-strapping locking system 50 is detached, the flat light panel 40 removed and the art 30 replaced. The above process for assembly is then followed to finish the replacement.

FIG. 3 shows an alternate embodiment of the invention wherein L-shaped retainers 120 are disposed at each corner of the flat light display 140, and the cross-strapping fastener 150 is disposed in an X-shaped configuration extending from corner-to-corner of the flat light panel 140 to thereby retainer the light panel 140 and artwork 130 within the display frame 110.

While the foregoing invention has been shown and described with reference to several preferred embodiments, it will be understood that various changes in form and detail may be made without departing from the spirit and scope of the present invention. For example, the flat light panel may be a backlight consisting of a single source fixed at the center of the frame. Another example is that the flat light panel is incandescent in nature picking up ambient light rather than supplying illumination. In addition, the specific layout of the cross-strapping fastener 50, 150 may be T-shaped, X-shaped, or grip-shaped with multiple straps extending in the vertical and horizontal directions. Likewise, the present invention may employ a single strap running in one direction across the back of the flat light panel.

What is claimed is:

1. A system for displaying artwork within a framed display, said system comprising:

a frame member having a display area;

a work of art disposed adjacent said display area for view through said display area;

an illumination device disposed adjacent to said work of art and having a back, said work of art being disposed between said frame member and said illumination device;

at least one retainer affixed to said frame member and comprising a first reclosable fastener; and at least one interlocking fastener extending across a portion of said illumination device back to retain said illumination device in position with respect to said frame member and to create an open backing of said frame member for dissipation of heat from said illumination device, said interlocking fastener comprising a second reclosable fastener, wherein said interlocking fastener is selective affixed to said frame member through said first and second reclosable fasteners which are selectively connected together to form a locking system.

2. The system according to claim 1, wherein said retainer comprises a plurality of straight arms positioned along side edges of said illumination device.

3. The system according to claim 1, wherein said retainer comprises a plurality of L-shaped mounting arms positioned at various corners of said illumination device.

4. The system according to claim 1, wherein said illumination device is a flat panel light defining a relatively thin arrangement fitting within a recess defined by said frame member.

5. The system according to claim 1, wherein said work of art is transparent artwork illuminated from behind by said illumination device.

6. The system according to claim 1, wherein said at least one retainer prevents lateral movement of said illumination device with respect to said frame member.

7. The system according to claim 1, wherein said locking system defined by said first and second reclosable fasteners comprise a plurality of mushroom shaped stems that interlock with one another and produce an audible snapping sounding to announce that the reclosable fasteners are locked while providing suitable tensile strength.

8. The system according to claim 1, wherein said framed display is at least one of a hanging picture frame, a standing display, and a table display.

9. The system according to claim 1, wherein said interlocking fastener comprises a flexible strap extending across and overlying said illumination device.

10. The system according to claim 9, wherein said second reclosable fastener is disposed on at least one terminal end of said flexible strap.

11. The system according to claim 1, wherein said interlocking fastener comprises a pair of flexible straps extending across and overlying said illumination device.

12. The system according to claim 9, wherein said second reclosable fastener is disposed on at least one terminal end of each flexible strap of said pair of flexible straps.

13. The system according to claim 11, wherein said pair of flexible straps form at least one of an X-shaped and T-shaped pattern along a back side of said framed display.

14. The system according to claim 1, wherein said interlocking fastener comprises at least one flexible strap extending across said illumination device.

15. A method of assembling a framed picture comprising the steps of:

providing a frame member having a display area;

providing artwork at said display area;

affixing at least one retainer member on said frame member;

positioning an illumination device adjacent said frame member at a position where said at least one retainer member limits lateral movement of said illumination device with respect to said frame member; and selectively interlocking at least one mounting strap with said at least one retainer member, said mounting strap extending across said illumination device to retain said illumination device against said frame member and said artwork.

16. The method of claim 15, wherein said step of selectively interlocking comprises a step of interlocking first fastener members disposed on said mounting strap with second fastener members disposed on said retainer member.

* * * * *